United States Patent [19]

Prodel

[11] 3,952,909

[45] Apr. 27, 1976

[54] BOTTLE CASE OF PLASTIC

[76] Inventor: Ulrich Heinrich Prodel, Grunstrasse 13, 4902 Bad Salzuflen, Germany

[22] Filed: Feb. 27, 1974

[21] Appl. No.: 446,206

[30] Foreign Application Priority Data

Mar. 8, 1973 Germany ..... 2311419

[52] U.S. Cl. ..... 220/21; 206/427; 217/20

[51] Int. Cl.[2] ..... B65D 1/24; B65D 1/02

[58] Field of Search ..... 220/21; 217/19, 20, 217/21, 22; 206/427

[56] References Cited

UNITED STATES PATENTS

| | | | |
|---|---|---|---|
| 1,693,906 | 12/1928 | Lippincott | 220/21 |
| 2,634,015 | 4/1953 | Bowen | 217/22 |
| 2,758,742 | 8/1956 | Farrell | 220/21 |
| 3,297,190 | 1/1967 | Cloyd | 217/19 |
| 3,362,561 | 1/1968 | Bakos | 220/21 |
| 3,401,814 | 9/1968 | Chiswell | 220/1.5 |
| 3,421,649 | 1/1969 | Waller | 220/21 |
| 3,432,063 | 3/1969 | Schoeller | 220/21 |
| 3,628,684 | 12/1971 | Sere | 206/427 |

*Primary Examiner*—George E. Lowrance
*Attorney, Agent, or Firm*—Robert E. Burns; Emmanuel J. Lobato; Bruce L. Adams

[57] ABSTRACT

A plastic case for transportation of loose bottles and also multi-bottle packs has low partitions dividing the case into individual bottle compartments. Side walls of the case have a height at least equal to the height of the partitions plus the height of the bottles. Packs sit on top of the partitions and hence above the bottom of the case. Individual bottles are received in the individual compartments and rest on the bottom. The partitions are high enough to keep the bottles from bumping one another. Spacers extend in from the side walls and engage packs resting on the upper edges of the partitions to keep the packs from slifting laterally. Some partitions may be higher than the rest to separate the packs from one another. The bottom may be above the lower edges of the side walls.

4 Claims, 4 Drawing Figures

BOTTLE CASE OF PLASTIC

Figure 1:
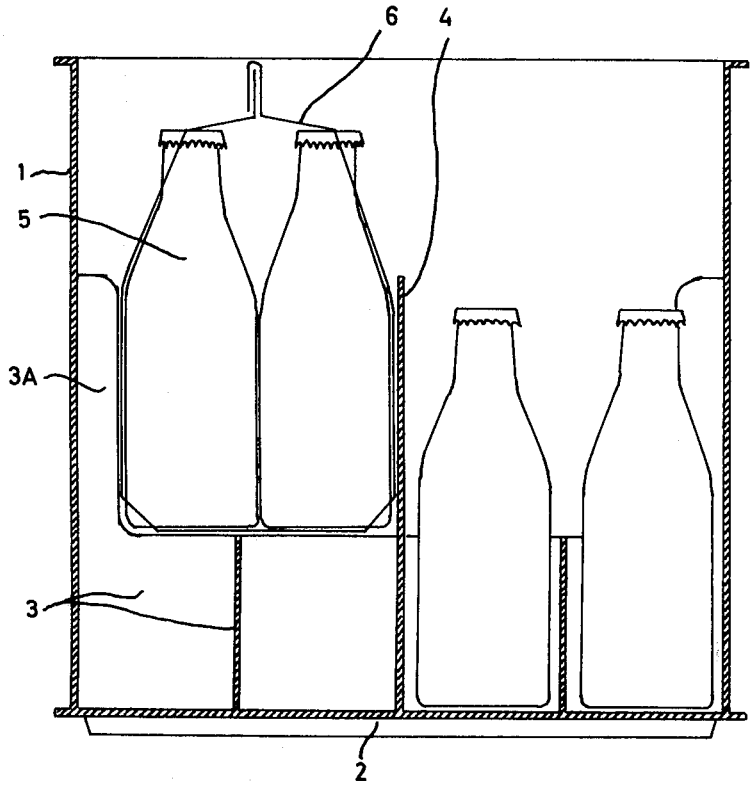

The present invention relates to a stackable bottle case of plastic which is suitable both for the transportation of loose bottles and of bottles packed in carriers, for example "six packs", and which consists of four side walls provided on top and bottom with edge reinforcements, a bottom, and partition walls forming individual bottle compartments.

It has been desired for a long time by the breweries to use strong, hygienic bottle cases of plastic also for the transportation of bottles packed in cardboard carriers. For the return transportation of the bottles which are no longer packed in carriers, provision should, however, be made in the bottle case so that the bottles do not strike against each other during transportation.

This is a very difficult problem for which up to now only one satisfactory solution has been found, which solution, however, makes it necessary for the carriers to have in their bottom large cutouts, as a result of which the strength of the carriers is reduced. This solution, set forth in an earlier proposal, consists in that there is present in the bottle case at least one compartment wall extending from one side wall of the bottle case to the other and by which the inside of the bottle case is divided up into compartments, and that at least in the inside of each compartment there is a spacer which prevents the empty bottles from striking against each other during transportation. It is these spacers which make the recesses in the bottom of the carriers necessary and thereby lead to a weakening of the carriers.

The present invention avoids this disadvantage and in an extremely simple manner provides a plastic bottle case suitable for the transportation of bottles placed in bottle carriers, the case being also suitable for the transportation of empty bottles not inserted in bottle carriers.

The invention resides therein that the height of the side walls of the case corresponds at least to the height of the lowest partition walls present in the case plus the height of the bottles to be transported.

In such a bottle case the carriers together with their contents are simply placed on top of the compartment walls. The inside of the bottle compartments then remains empty upon the transportation of the full bottles. If, on the other hand, bottles —generally empty bottles— no longer in the carriers are transported, then the bottles stand individually in the bottle compartments and cannot contact or damage each other. The bottles can then be removed from the bottle case by means of automatic mechanical unloading devices.

In this connection it is advisable for the height of the compartment walls to be different, the higher compartment walls surrounding a plurality of bottle compartments formed by lower compartment walls. The higher compartment walls are arranged in such a manner that they in each case accommodate one carrier filled with bottles. In this way a dependable supporting of even individual carriers in a bottle case is assured.

Bottles of the kind used for beer and other beverages customarily have a body portion and a neck portion. The lower compartment walls defining compartments preferably have a height at least half the height of the body portions of the bottles to be transported so as to separate the bottles effectively and prevent them from bumping one another. To avoid excessive overall height of the case, the height of the lower compartment walls preferably does not exceed half the height of the bottles including the neck portions. The higher compartment walls have a height sufficiently higher than the lower compartment walls to separate effectively bottle carriers placed in the compartments defined by the higher compartment walls and sitting on top of the lower compartment walls.

The height of the low compartment walls need not be uniform and the same throughout their extent; it may advisedly increase suddenly towards the side walls. In this way not only is the stability of the compartment system and of the bottom increased, but there is also created a lateral supprt for the bottle-filled carriers placed in the case. The carriers then stand firmly and safely in the case, since the bottles in the bottle-filled carriers are closer together than in a case subdivided by compartment walls.

The bottle case of the present invention can have a bottom which is located —as in all bottle cases up to the present time— at the height of the lower edge of the side walls. In the case of the bottle case of the invention, it is, however, also possible to arrange the bottom higher and thereby obtain certain essential advantages. If, namely, the bottom is arranged above the lower edges of the side walls at a height which is approximately equal to the height of the lower compartment walls, not only is the possibility provided of providing recesses in the lower edge portions of the side walls, so that the stacking forks of fork lift trucks can grip under stacks of bottle cases and can lift and displace the stacks of bottle cases without pallets and other stacking means, lift them onto transport vehicles and carry out similar manipulations. There is the further advantage that the carriers which are filled with bottles protrude somewhat from the top of the bottle case and thus the seller in a foodstore can immediately see what cases still contain carriers with bottles, since, when the empty bottles are placed in the case, the necks of the empty bottles do not protrude above the upper edge of the case.

Figure 2:
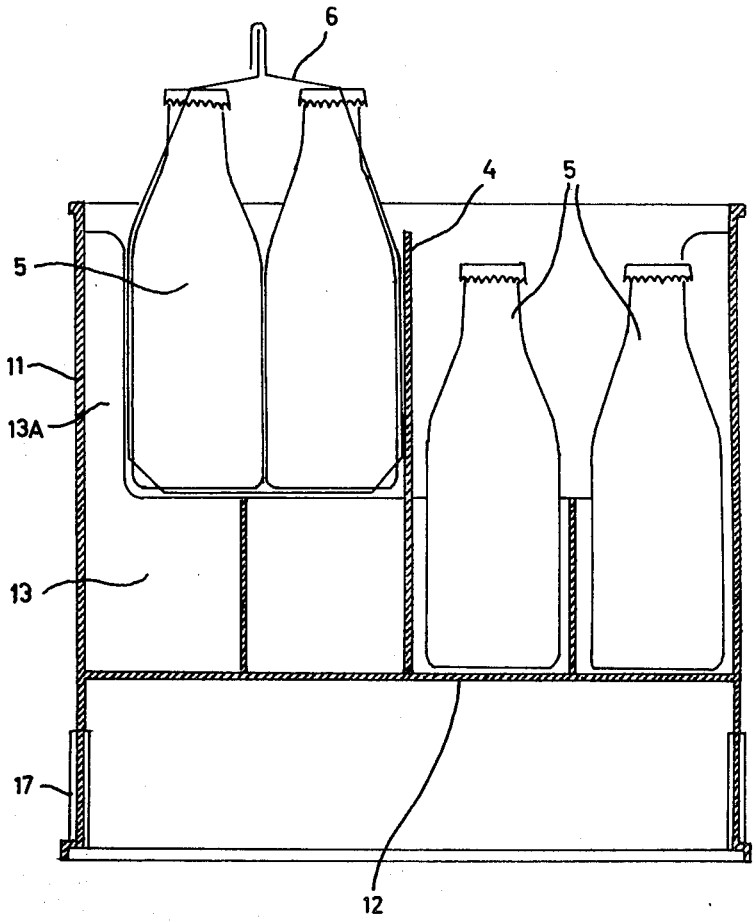
Figure 3:
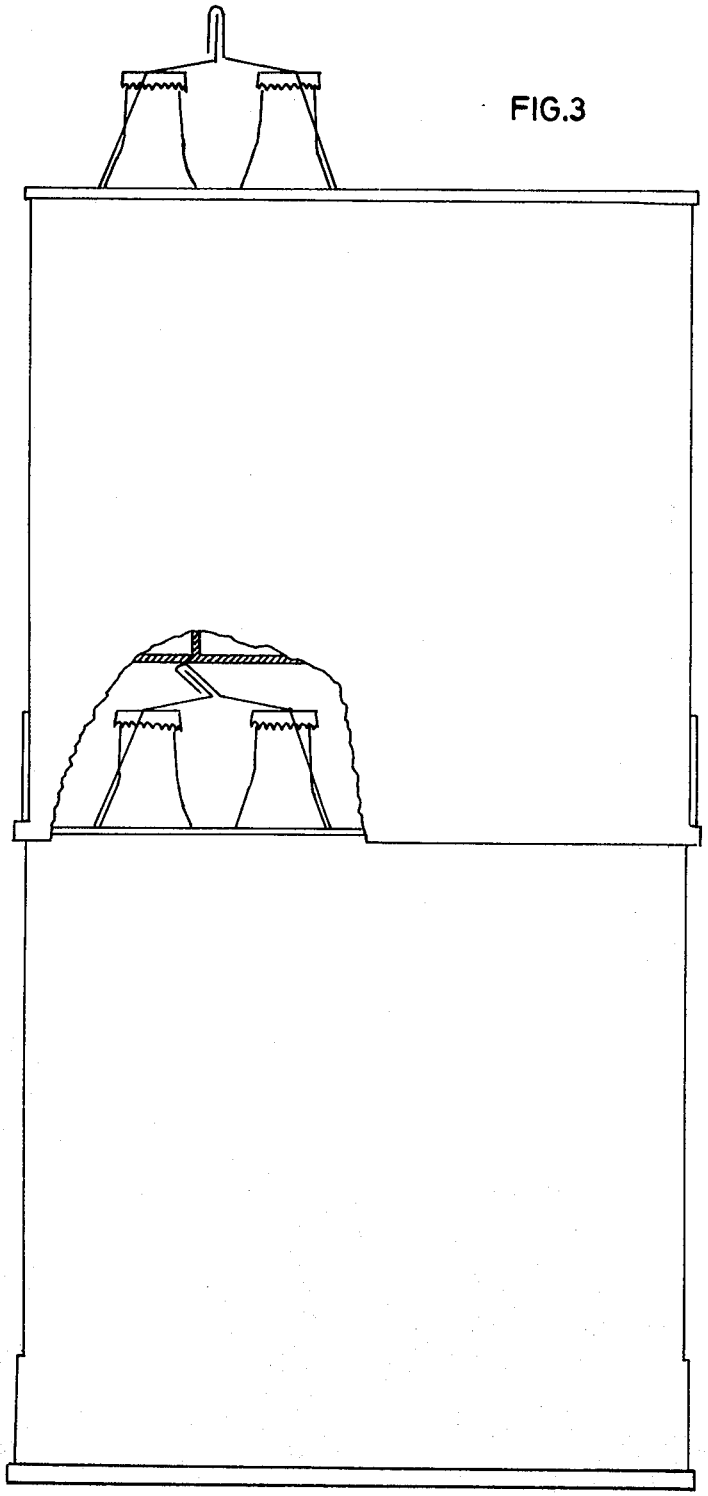
Figure 4:
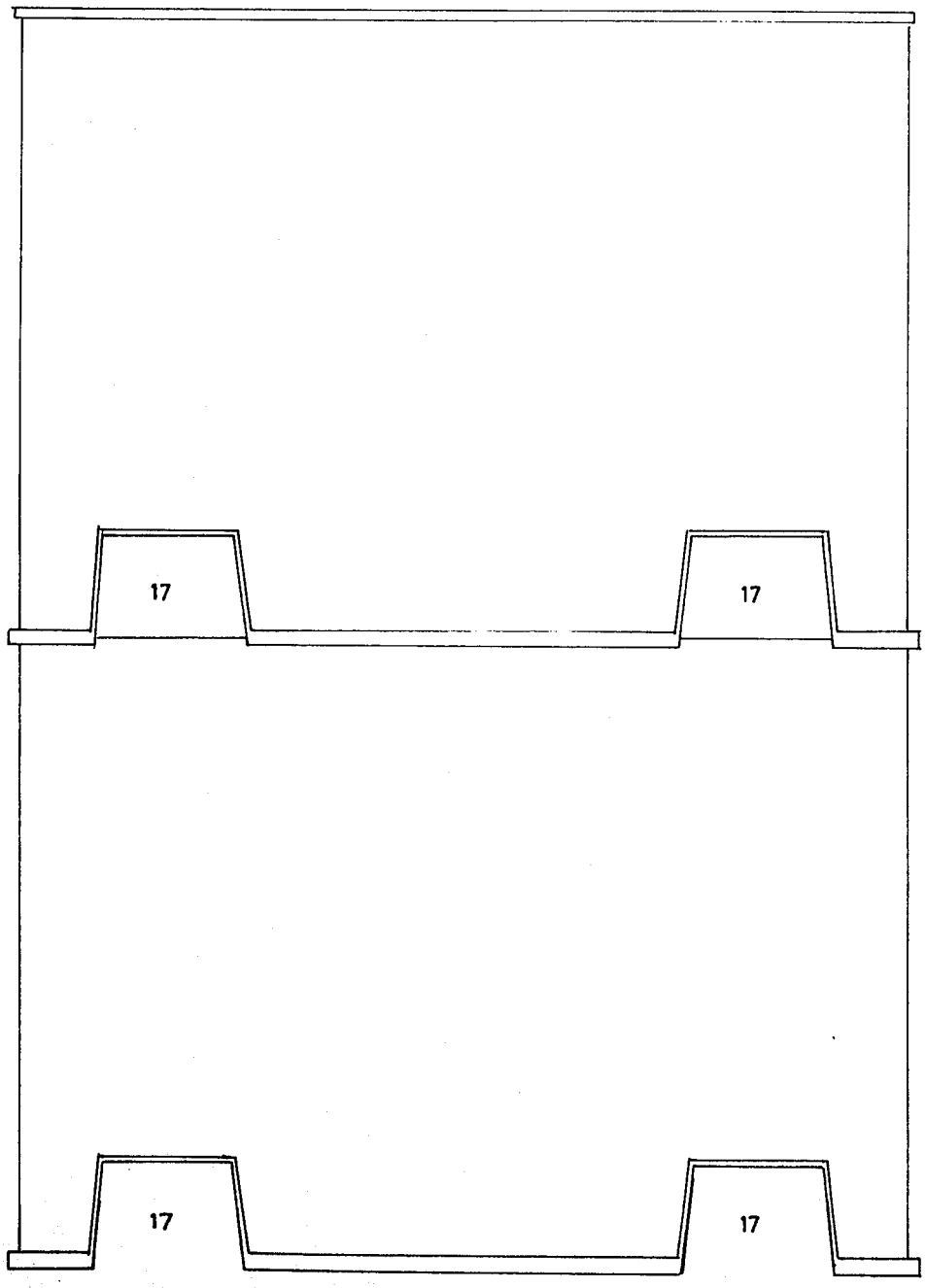

The essence of the present invention will be explained in further detail with reference to two illustrative embodiments shown schematically in the drawing in which:

FIG. 1 is a cross section through a bottle case, the bottom of which is located at the height of the lower edge of the side walls, FIG. 2 shows a bottle case the bottom of which is located at a distance from the lower edge of the side walls at a height which corresponds to the height of the lower compartment walls, FIG. 3 shows a stack of two cases of the kind shown in FIG. 2 in a view of the narrow side partially in section, FIG. 4 is a longitudinal view of a stack of bottle cases of the type shown in FIG. 2.

The bottle case of FIG. 1 is rectangular and has four side walls 1 and a bottom 2. The upper and lower edges of the side walls are reinforced to provide for stacking of the cases. The inside of the bottle case is divided into individual bottle compartments by low compartment walls 3 and high compartment walls 4. The high compartment walls 4 divide the case into compartments of a size for each compartment to hold one bottle carrier. The low compartment walls further divide the case into compartments of a size for each compartment to hold one bottle. In the righthand part of FIG. 1 it can be seen how two empty bottles which are not packed in a carrier stand in the bottle compartments. In the lefthand part of FIG. 1 it is shown how a carrier 6 which is filled with bottles 5 stands on the lower compartment walls 3. Due to the fact that in this case the height of the side walls 1 is at least equal to the height of the lowest compartment walls 3 plus the height of the bottles 5 to be transported, the result is obtained that cases of the type shown in FIG. 1 can be stacked one on top of the other, provided that their edges are provided with the known edge construction necessary for stacking without danger of slipping.

The lowest compartment walls 3 are not of uniform height. In the vicinity of the edge their height is suddenly increased in order to form portions 3A which extend to approximately the same height as the high compartment walls 4. These portions 3A provide lateral support for the carriers in which the bottles are closer together than they would otherwise be in the bottle case.

The bottle case of FIG. 2 is of somewhat different development in that the bottom 12 is at a distance from the lower edge of the side walls 11. The height of the bottom 12 from the lower edge of the side walls 11 is at a height which is approximately equal to the height of the low compartment walls 13. In this way the result is obtained that with a stack of bottle cases stacked on top of each other there is left at the bottom an empty space to receive the stacking forks of a fork lift truck in order to raise the stack of bottle cases. For this purpose there are provided recesses 17 in the lower edges of the side walls 11.

By this construction the result is obtained that carriers which are filled with bottles protrude out of the top of the case and are thus readily visible when the bottle cases are set up, for instance, in a foodstore. Empty bottles on the other hand, as shown on the righthand half of FIG. 2, are so deep in the bottle case that their necks do not extend above the upper edge of the side walls 11. This constitutes an important sales aid, since it can be noted by a glance whether carriers containing bottles are still present in the bottle cases. Upon the transportation of stacked bottle cases, the upward protruding carriers disappear into the empty space below the bottom of a bottle case stacked above same. This can be seen in FIG. 3.

The bottle case of the present invention can be made with rectangular or square bottle compartments. For a firm supporting of the carriers on the upper edge of the compartment walls, however, a honeycomb compartment is particularly advantageous, in which the walls of the individual bottle compartments are arranged, for instance, in a hexagon. In this case the compartment walls are extended upward as support for the filled carriers merely in the region of the edge, while elsewhere —and therefore also in the central region— the compartment walls are of the same height, so that the filled carriers support each other in the center of the case.

While preferred embodiments of the invention have been illustrated in the drawings and are herein particularly described, it will be understood that the invention is in no way limited to these embodiments.

What I claim and desire to secure by Letters Patent is:

1. A bottle packing for returnable bottles having body portions and necks, comprising a stackable bottle case of plastic comprising four side walls provided on top and bottom with edge reinforcements, a bottom, and crossing partitions extending between opposite side walls and upwardly from said bottom to divide the interior of said case into individual bottle compartments, said partitions having upper edges parallel to said bottom, a plurality of multiple bottle packs disposed between said side walls and resting on the upper edges of at least some of said partitions, each of said packs comprising a plurality of bottles in a carriable container, the height of said side walls being at least equal to the height of said partitions on which said packs rest plus the height of said bottles, and the inside cross sectional area of said case being greater than the combined cross sectional area of the packs received therein, and spacers extending inwardly from side walls of said case, said spacers comprising upwardly extending portions of at least some of said partitions and having abutment edge faces extending upwardly parallel to the side walls and engaging said packs to prevent lateral shifting or tipping of said packs in said case, individual bottles not in packs being receivable in an upright position in said compartments and being supported by said bottom, said partitions having a height at least equal to half the height of the body portions of said bottles so as to prevent said individual bottles from bumping one another but not exceeding half the height of said bottles including said necks, said case alternatively accommodating the same number of bottles in said packs as in said individual bottle compartments.

2. A bottle packing according to claim 1, in which selected partitions are higher than the remaining partitions so as to divide the interior of said case into spaces for individual packs, said packs being supported by lower partitions and being separated from one another by said higher partitions.

3. A bottle packing according to claim 1, in which said bottom is disposed above the lower edges of the side walls at a distance not exceeding the height of said partitions on which said packs rest, whereby said packs extend upwardly above the side walls of the case and when filled case are stacked, are received in space below the bottom of a superposed case, while individual bottles are received wholly within the case in which they are placed.

4. A bottle packing according to claim 3, in which recesses are provided in at least one side wall below the bottom of the case, said recesses being spaced from one another to accommodate the forks of a fork-lift truck for lifting said case.

* * * * *